US006829966B1

(12) United States Patent
Bramuchi

(10) Patent No.: US 6,829,966 B1
(45) Date of Patent: Dec. 14, 2004

(54) TRACK FASTENING HAMMER

(76) Inventor: Robert M. Bramuchi, 2416 Winterwood Cir. West, Jacksonville, FL (US) 32210

( * ) Notice: Subject to any disclaimer, the term of this patent is extended or adjusted under 35 U.S.C. 154(b) by 0 days.

(21) Appl. No.: 10/373,713

(22) Filed: Feb. 27, 2003

Related U.S. Application Data

(60) Provisional application No. 60/380,922, filed on May 16, 2002.

(51) Int. Cl.[7] ..... B25D 1/14

(52) U.S. Cl. ..... 81/26; 81/23; 81/44

(58) Field of Search ..... 81/20, 23, 44, 81/26, 27; 227/147; D8/75, 77–79, 81; 7/143, 146, 147

(56) References Cited

U.S. PATENT DOCUMENTS 147,113 A * 2/1874 Ellsworth ..... 7/147
362,224 A * 5/1887 Newman ..... 81/23
506,935 A * 10/1893 Potts ..... 81/20
D27,861 S * 11/1897 Hooker ..... D8/81
3,786,847 A * 1/1974 Schera, Jr. ..... 81/27

* cited by examiner

*Primary Examiner*—Debra S. Meislin
(74) *Attorney, Agent, or Firm*—Peter O'Donovan Gibson

(57) ABSTRACT

A hammer configuration possessing a conventional striking end opposed to a fastening pin starting end presenting a cylindrical blind cavity enables manual starting of a collared fastening pin typically utilized in fastening metal tracks to typically concrete substrates and driving of the same home with placement of the fastening pin in the blind cavity, striking and penetrating the metal track with the exposed point of the fastening pin embedding the same partially in the substrate, retracting and then rotating the hammer head 180°, and striking the head of the fastening pin with the flat face of the conventional striking end. An optional bifurcated claw on the top of the head provides optimal leverage in conventional use pulling nails also driven by the conventional striking end. Conventional use with nails and similarly driven fasteners and safe, efficient, and reliable starting and driving of collared fastening pins is provided in a single hammer.

7 Claims, 3 Drawing Sheets

FIGURE 2
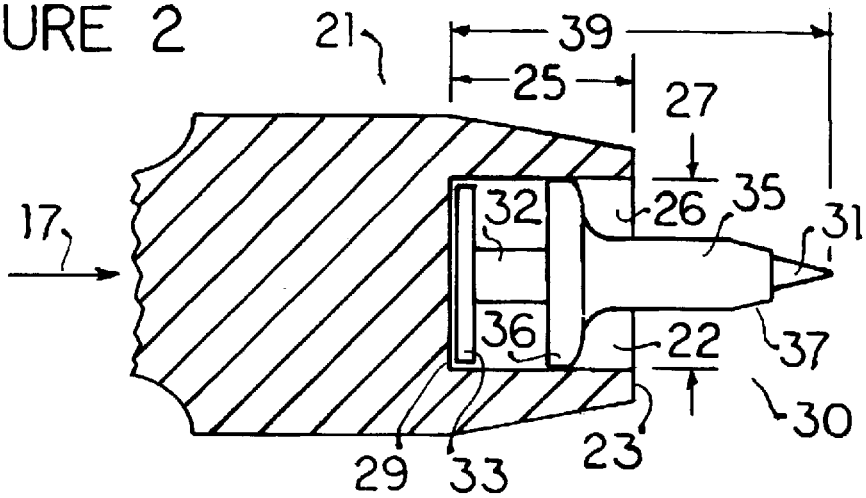
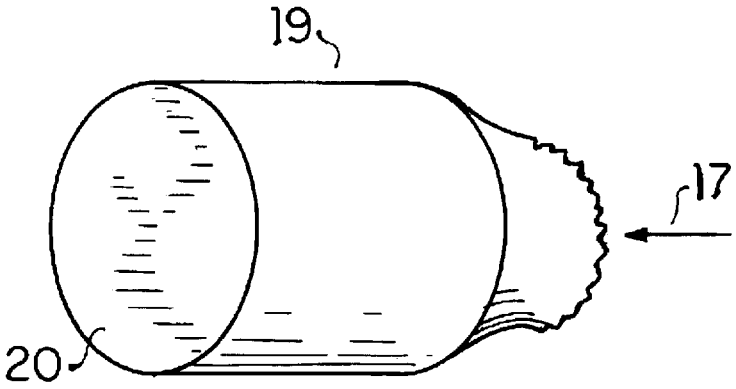
FIGURE 3

FIGURE 4
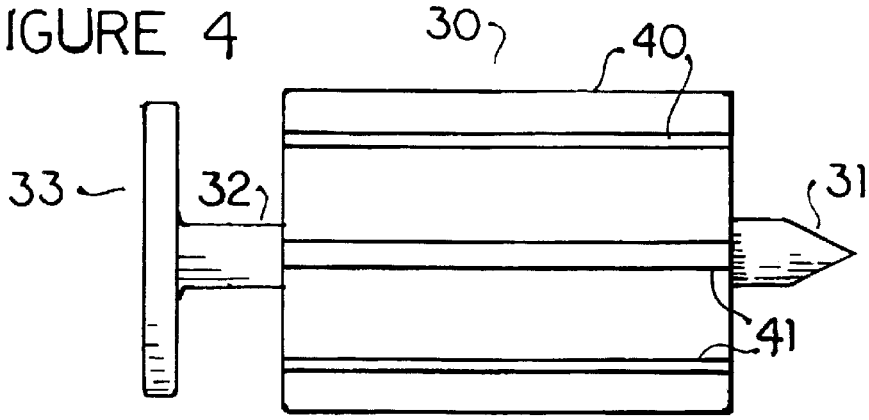
FIGURE 5
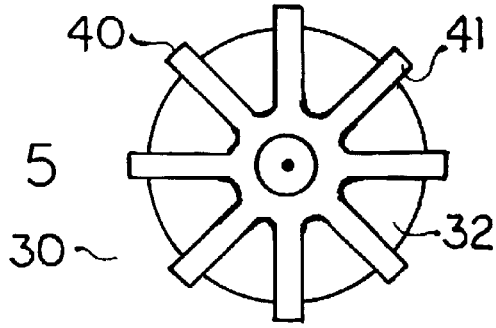
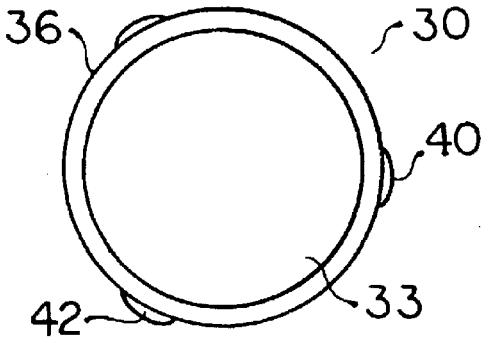
FIGURE 6

TRACK FASTENING HAMMER

BENEFIT OF EARLIER FILING DATE

The present applicant for patent claims benefit of the earlier filing date of Provisional Application No. 60/380,922 filed May 16, 2002 in the name of the present Applicant.

BACKGROUND OF THE INVENTION

1. Field of the Invention

The present invention relates generally to hammers, more particularly to hammers having a nail placer, and most specifically to hammers having a nail placer for driven type fasteners.

2. General Background

Lengths of metal channels, commonly known as 'tracks' as used in construction, are typically fastened to concrete substrates with the use of driven type fastening pins possessing an outer collar that is shorter than the central steel member and typically possesses a radially symmetric configuration, most typically or a longitudinal set of exterior radial splines of substantially uniform diameter but also characterized by a shoulder at an upper end with an enlarged diameter. The central steel member has an outward flange or head at the top end presenting a flat circular top impact surface. The maximum diameter of the collar is slightly greater than the diameter of the impact surface of the head. This structure is considered to be ideally suited to use in powder actuated and fuel cell type guns as the radially symmetric collar facilitates feeding or guiding of the fastening pin. Use of radial ribs on the most typical type of fastener, as opposed to a solid cylindrical shape, and provision of the shoulder with radially spaced small outward protrusions or buttons, are both intended to avoid jamming in powder actuated or fuel cell type guns.

Building construction workers typically use powder actuated or fuel cell type guns specifically for driving fastening pins through metal tracks and into concrete substrates typically forming walls or floors and use other hand tools such as a conventional hammer and or drywall hatchet in constructing interior walls typically braced at ends to poured concrete slab walls by the fastened metal tracks. Conventional, clawed, hammers typically used by workers in building construction are considered to be well known. The head has a bifurcated claw end opposed to a generally cylindrical end presenting the substantially flat, circular, impact surface applied to the heads of conventional nails for the purpose of fastening wood members. The claw is used to pry a poorly hammered nail from the wood. In a heavier version with a comparatively shallow claw the same is generally known as a wrecking hammer for self explanatory purposes.

It considered that hammers of other configurations are known including tack hammers for tacking or light work, ball peen hammers for metal work, et cetera. Most pertinently to the problem addressed herein a variety of hammers having nail placers are known. A nail placer allows one to place a nail with the hammer as opposed to holding the nail with one hand against a surface and directing the blow of the hammer toward the same. A hammer with a nail placer allows one to start the nail without placing the fingers of a hand in the path of the impact surface of the hammer head. The benefit derived is elimination of a potential hazard to the fingers of the hand holding the nail.

Track fasteners are generally too short and of too awkward a shape to be easily held by one's fingers, particularly at the bottom of a relatively narrow channel which prohibits flattening of the hand. The impact necessary to start a track fastener in metal track is much greater than that necessary to start a nail in the wood used in construction and placing a track fastener with one's fingers for starting the same with the blow of a conventional hammer is considered to impose an unacceptably high level of hazard upon the task.

A hammer that might be used to start a track fastening pin of the kind described therefor necessarily must possess a nail placer suitable to the specific shape and configuration of the typical track fastening pin as described in some detail above. And the prior art considered pertinent to the present invention is hence defined by this characteristic coincident with the language used by the U.S. Patent Office Classification System found in the 'Field of the Invention' above.

| Patent # | Inventor | Date | Title |
|---|---|---|---|
| References Cited | | | |
| 1. U.S. Pat. No. 661,198 | Thurston | 6 Nov., 1900 | Hammer For Straightening Saw Blades |
| 2. U.S. Pat. No. 2,517345 | Pies | 1 Aug., 1950 | Shingle Gauge Attachment For Hammers |
| 3. AU 164,189 | Miller | 5 Aug., 1954 | Improvements in or relating to carpenter's hammers |
| 4. U.S. Pat. No. 4,073,327 | Pearson | 14 Feb., 1978 | Magnetic Head Hammer |
| 5. U.S. Pat. No. 4,732,058 | Chung | 22 Mar., 1988 | Measuring Hammer |
| References Noted | | | |
| 1. U.S. Pat. No. 96,061 | Warner | 19 Oct., 1869 | Lasting Hammer |
| 2. U.S. Pat. No. 175,322* | Avery | 28 Mar., 1876 | Tack Hammer |
| 3. U.S. Pat. No. 239,777 | Hepfinger | 5 Apr. 1881 | Tack Hammer |
| 4. U.S. Pat. No. 392,515 | Hoover | 6 Nov. 1888 | Tack Hammer |
| 5. U.S. Pat. No. 812,947 | Molkenthin | 20 Feb. 1906 | Combination Tool of the Hammer Type |
| 6. U.S. Pat. No. 1,960,390 | Nadelman | 29 May 1934 | Nail Setting Tool |
| 7. AU 141,678 | Miller | 6 Oct., 1949 | An improved hammer |

*Note. Full copies of all twelve references cited and noted above were reviewed but only the face sheet of Avery was found in the stacks of the U.S. Patent Office Public Search Room and only the references cited are discussed below.

DISCUSSION OF THE REFERENCES CITED

The presumed brothers Thurston disclose a hammer with the shaft connected to an end of a heavy, longitudinally tapered, head having a blind cavity, of cylindrical, oblong, square, or of triangular shape, centrally located and open to the impact face on the opposed, thicker, end of the head. The impact face is necessarily convex, sloping backward in a radially outward direction from the central cavity, in order to avoid deformation of the teeth on the saw blade adjacent to the tooth avoided by the blind cavity during straightening of the blade with the hammer.

Pies discloses a 'shingle gage attachment for hammers' having an externally threaded extension with a distal flange threaded into a tapped bore through an end of the hammer head connected to the shaft bore and opposed to the end having the impact face. The threaded extension has a 'gauging abutment 16' or flange on its end and is fixed by means of a lock nut at any desired extension thereby providing a gauge convenient to someone laying roof shingles and obviating the need for a chalk line for each successive row of shingles.

Miller discloses a claw hammer having a deep smooth walled cylindrical blind cavity open to the back, claw equipped, end of the head having an arcuate thin strip of steel disposed therein shaped to exert downward pressure upon the length of a nail inserted in the cavity thereby retaining the same therein. A tapered V shaped groove centered at the bottom of the open cavity centers the length of a nail disposed therein. The steel strip is fastened to the blind end of the cavity with a semi-spherical head bolt screwed into a tapped aperture behind the blind end which shape ensures, together with the centered groove, that the center of the impact surface of the nail head is contacted during the blow using the bolt head as a striking point for delivery of impact.

Pearson discloses a conventional claw hammer having a cylindrical magnetic insert made of high carbon hardened steel heat treated prior to magnetization press fitted into a cup shaped sleeve or 'magnetic shield thimble 6' in turn press fitted into a cylindrical blind cavity formed in the impact face of the head of the hammer thereby "presenting a flush face which may then perform the combined functions of magnetic pick-up and driving over long periods of time without impairing the function of the magnet." (Abstract)

Chung discloses a 'measuring hammer' having a scale incised along the steel shank integral to the head above the rubber sleeve handle further possessing a round cavity, or nail holding aperture 16 which is adapted to receive a nail" open to the surface opposed to the end with the impact surface, below the base of the claw, and disposed to retain the head of a common nail extending backward through the wedge shaped gap between the bifurcated claws while starting a nail.

Note

The 'nail holding aperture' co-operating with the bifurcated claws in 'starting a nail' in Chung is known in many variations in the prior art which is otherwise mainly characterized by attachments or slots on the side of the hammer head for starting a nail with the hammer in a forward position, as indicated by the references cited.

STATEMENT OF NEED

The references cited represent all the prior art found disclosing a hammer structure possessing a cylindrical blind cavity open to an end of the head of the hammer. While the purpose of the cavity varies, still, regardless of the purpose, no reference was found in the pertinent prior art which disclosed use of a smooth walled cylindrical blind cavity of sufficient depth to hold a collared type track fastening pin concentrically therein centrally located upon a distal face of a double ended hammer head. The particular problem addressed by the present invention, safely starting a track fastening pin with a simple hammer that can also be used for other conventional purposes, is wholly absent from the pertinent prior art and the references cited herein are considered to be the closest structure found necessary for address of this specific problem as well as the references considered to be closest in function.

It is considered that powder actuated and fuel cell type guns are: heavy, expensive, prone to incur significant downtime, and are dedicated to a particular fastening operation; all in contrast to a conventional hammer. And it is considered that while hammers of a wide range of configurations aside from conventional claw hammers are known that have a nail placer, all are useful only for conventional nails and none are suitable for starting a collared type track fastener with a hammer safely. And, of course, powered guns dedicated to starting and driving collared type track fasteners safely are useless with conventional nails. A need is hence recognized for a hammer which can be used in a conventional manner with nails that can also safely start and drive collared typed track fasteners.

SUMMARY OF THE INVENTION

OBJECTS OF THE INVENTION

The encompassing object of the present invention is a tool suited to both: starting collared type track fasteners without having to hold the fastener with one's fingers; and conventional use as a hammer in driving this and other fasteners including nails.

A first ancillary object of the present invention is a tool suited to starting collared typed track fasteners without fingers holding the fastener and to conventional use as a hammer in driving these and other fasteners that is less expensive than a powered track gun.

A second ancillary object of the present invention is a tool suited to starting collared type track fasteners without fingers holding the fastener and to conventional use as a hammer in driving these and other fasteners that is less massive than a powered track gun.

A third ancillary object of the present invention is a tool suited to starting collared type track fasteners without fingers holding the fastener and to conventional use as a hammer in driving these and other fasteners that is simple, durable, and hence not subject to lapses in operation by reason of mechanical jamming and other problems.

A first auxiliary object of the present invention is a tool suited to starting collared typed track fasteners without fingers holding the fastener and to conventional use as a hammer in driving these and other fasteners that is basically one piece and possesses no moving components.

A second auxiliary object of the present invention is a tool suited to starting collared type track fasteners without fingers holding the fastener and to conventional use as a hammer in driving these and other fasteners that is easily used in comparatively tight places.

Other auxiliary objects of the present invention include a tool suited to starting collared type track fasteners without fingers holding the fastener and to conventional use as a hammer in driving these and other fasteners that enables precision, speed, and ease in operation.

PRINCIPLES OF THE INVENTION

In achievement of the above stated objectives it is suggested that a hand held hammer be provided having both a conventional striking structure at one end of the head, to enable conventional use in driving both collared type track fasteners and other types of driven fasteners including nails, and an appropriately configured structure on the opposed end of the head for starting collared track fasteners. After starting a track fastener with the opposed end it is suggested that the hammer be rotated one hundred eighty degrees and driven with the conventional striking structure on the other end of the head. It is suggested that a cylindrical blind cavity open to the distal end of the head suited to starting a collared track fastener possess a diameter and depth appropriate to stable disposition of the same therein. It is specifically suggested that the diameter of the cylindrical blind cavity be approximately equal to the maximum diameter of the collar and therefor slightly larger than the diameter of the flanged head of the central steel pin of a collared track fastener. And it is specifically suggested that the depth of the cylindrical blind cavity be at least sufficient to admit insertion of both the head and a portion of the collar of the track fastener sufficient to provide a stable disposition.

Together these two physical aspects ensure stability in both the placement of the track fastener into the cylindrical blind cavity and starting the same with a blow of the hammer directing the point of the central fastening pin against the desired surface. The fastening pin point is easily driven through the track surface with one blow starting the track fastener. A collared track fastener is held in placed position by contact of radially balanced contact surfaces against the interior wall of the cylindrical blind cavity which must simply have a depth sufficient to allow insertion of a portion of the maximum diameter of the collar therein to ensure against accidental displacement.

It is suggested that the exterior configuration about the cylindrical blind cavity be radially uniform and possess a slight taper inward toward the distal face upon which the cavity opens. This configuration places nearly all the mass of this striking end, and hence the hammer head, behind the bottom of the blind cavity and hence behind the head of the fastening pin of a track fastener disposed therein. This configuration also minimizes the area presented about said cavity opening thereby facilitating greater accuracy in starting the track fastener as restrictions imposed by desired physical location, for example at the end of a narrow channel track, are obviated.

With the centerline of the cylindrical blind cavity coincident with the centerline of an opposed conventionally configured striking end, the configuration of the head provides for an intuitive feel in use of either end of the head of the hammer in starting and then driving home the fastening pin. Symmetry about a medial plane through the centerline is also desired for ensuring an intuitive feel in use in either direction. It is noted, however, that the relative mass, and hence weight, upon either end of the head is not important in this regard and the striking end is preferably of lesser size than that of the opposed, solid, conventional striking head.

It is suggested, moreover, that the head be manufactured in one piece, preferably with conventional forging or casting techniques. An insert for the forging die is necessary for the blind cavity as well as a central head through cavity for the handle if a traditional hammer construction is utilized having a spike wedged into the top of the handle. Alternatively the handle can be forged in one piece with the head, brazed within a blind cavity of the head, or fixed by any other suitable, including threaded, means. It is suggested, regardless of specific manufacturing means, that a bifurcated claw be provided upon the top of the hammer head. This location places the fulcrum involved proximate the longitudinal axis of the handle thereby providing optimal leverage.

Other objects and advantages may be discerned in review of the detailed description following; especially if made with reference to the drawings attached hereto and briefly described immediately below.

BRIEF DESCRIPTION OF THE DRAWINGS

FIG. 2 is a cross sectional detail view of the track fastener striking end of a preferred track fastening hammer with a typical track fastener placed for starting.

FIG. 3 is an isometric detail view of the conventional striking end of a preferred track fastening hammer.

FIG. 4 is a plain elevational view taken from the side of a typical radial rib collared track fastener.

FIG. 5 is a plain elevational view taken from the front end of the typical radial rib collared track fastener depicted in FIG. 4.

FIG. 6 is a plain elevational view taken from the back end of the shoulder collared track fastener depicted in FIG. 2.

NOMENCLATURE

Figure 1:
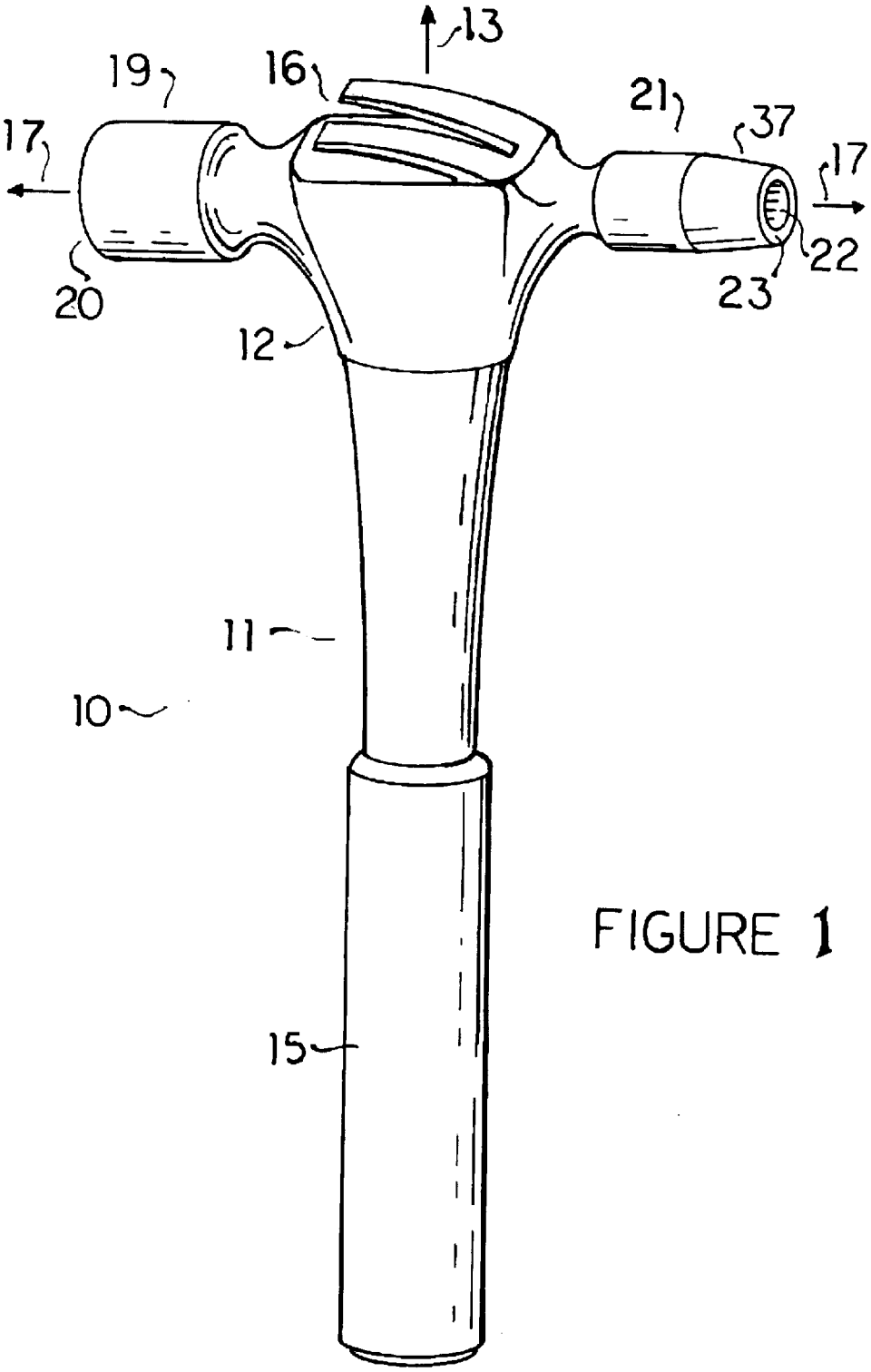
FIG. 1 is an isometric view of a preferred track fastening hammer in accordance with the principles relating to the present invention.

| | |
|---|---|
| 10 | track fastening hammer |
| 11 | handle |
| 12 | head |
| 13 | longitudinal axis |
| 15 | grip |
| 16 | bifurcated claw |
| 17 | striking axis |
| 19 | conventional striking end |
| 20 | flat face |
| 21 | track fastener striking end |
| 22 | blind cavity |
| 23 | annular face |
| 25 | cavity depth |
| 26 | cavity wall |
| 27 | cavity diameter |
| 29 | cavity bottom |
| 30 | track fastener |
| 31 | fastener point |
| 32 | fastener pin |
| 33 | fastener head |
| 35 | collar |
| 36 | shoulder |
| 37 | taper |
| 39 | fastener (pin) length |
| 40 | contact surface |
| 41 | radial rib |
| 42 | button |

DETAILED DESCRIPTION OF PREFERRED EMBODIMENT

The track fastening hammer 10 depicted in FIG. 1 is seen therein to be basically comprised of a handle 11 and a head 12 perpendicularly disposed to a longitudinal axis 13 through the handle 11 which also is shown with a grip 15 upon its lower half. A bifurcated claw 16 is seen on top of the head 12 located to place its fulcrum in operation pulling nails proximate the longitudinal axis 13 of the handle 11. The longitudinal axis 13 of the handle is perpendicular to a striking axis 17 through both the conventional striking end 19, which possesses a flat face 20 as better seen in FIG. 3, and the track fastener striking end 21 which possesses a blind cavity 22 bounded by an annular face 23. The blind cavity 22 is cylindrical and preferably symmetric about the striking axis 17. The conventional striking and track fastening ends 19, 21 are also both preferably substantially cylindrical as shown and substantially symmetric about the striking axis 17. A slight taper 37 distally inward from the substantially cylindrical track fastening end 21 may also be observed thereby placing nearly all of the mass of the head 12 behind the blind cavity 22 and reducing the surface area of the annular face 23 about the same.

The bifurcated claw 16 is not necessary to fulfillment of the principles relating to the present invention and can be omitted entirely if desired. If included the bifurcated claw 16 preferably, as shown in FIG. 1, comprises an integral extension of the head 12. It is also suggested that the bifurcated claw 16 be provided as a separate frame piece having two parallel spaced apart feet connected by a traverse cross bar trapped by a staple driven into the top of the handle 11 in place of the wedge conventionally used to expand the top of a wood or other non-metal material handle 11 within a central cavity through the head 12 securing the two together. The grip 15 on the handle is also strictly optional as is the actual manner of manufacture as mentioned above in summary and discussed further below.

Most importantly, with regard to fulfillment of the principles relating to the present invention, the blind cavity 22 open to the distal end of the track fastener striking end 21 must be dimensioned, as clearly shown in FIG. 2, to hold a typical track fastener 30. Another, more typical, type of track fastener 30, possessing radial ribs 41, is shown in FIGS. 4 & 5. In having longitudinal radial ribs 41 of substantially uniform diameter this more typical type of track fastener 30 is very easily placed into and securely held by a cylindrical blind cavity 22 in accordance with the principles relating to the present invention as each radial rib 41 possesses a longitudinal contact surface 40 readily providing aligned placement in radially balanced contact with the cavity wall 26.

The most typical type of track fastener 30 is shown in FIGS. 4 & 5 and the type of track fastener 30 shown in FIG. 2 is less typical mainly in possessing a shoulder 36 instead of a generally cylindrical sheath. The shape is still radially symmetric but the maximum diameter is presented only by the shoulder 36 of the collar 35 which is preferably placed well within the blind cavity 22 to ensure maximum stability in contact with the cavity wall 26. The shoulder 36 further typically possesses a plurality, most typically three, buttons 42 or slight protrusions as shown in FIG. 6 that are intended to provide radially balanced contact with the walls of the bore of a powered track fastener gun and contact the cavity wall 26 of a blind cavity 22 in preferred accordance with the principles relating to the present invention.

The cavity depth 25 is necessarily of lesser dimension than the length 39 of the track fastener 30. The radially uniform cavity wall 26, moreover, preferably makes sliding contact with the radially balanced contact surfaces 40 presented by the collar 35 encasing most of the length 39 of the central fastener pin 32 and hence the cavity diameter 27 is preferably equal to the maximum diameter of the collar 35 and slightly greater than the diameter of the fastener head 33 comprising a top flange of the central, steel, fastener pin 32 which is intended to be disposed, as seen in FIG. 2, against the cavity bottom 29. The fastener head 33 must fit fully within the blind cavity 22 and the cavity depth 25 preferably leaves approximately one half of the track fastener length 39 protruding from the blind cavity 22 substantially as shown in FIG. 2 in starting a track fastener 30.

With regard to operation of a track fastening hammer 10 in accordance with the principles relating to the present invention a typical track fastener 30 is placed in the blind cavity 22 of the track fastener striking end 21 as shown in FIG. 2 with the fastener head 33 against the cavity bottom 29 with the collar 35 held in slidable contact against the cylindrical cavity wall 26. The fastener point 31 is directed against the surface of the metal track to be penetrated in fastening the same to a backing substrate, typically a concrete wall, floor, or ceiling, with a swing of the hammer in the direction of the track fastener striking end 21 without fingers holding the track fastener 30.

The resulting impact forces the fastener point 31 through the metal track and into the backing substrate imbedding the track fastener 30 in the track and substrate. The track fastening hammer 10 is retracted. The track fastener 30 is retained by embedment in the track and substrate and thus started. The track fastening hammer 10 is then rotated about the longitudinal axis 13 of the handle 11 180° and the fastener head 33 is hit with the flat face 20 of the conventional striking end 19 to drive the fastening pin 32 fully into the backing substrate until the fastener head 33 contacts the surface of the metal track.

Manufacture of a track fastening hammer 10 in accordance with the principles relating to the present invention can be by any means known to one skilled in the art. The best known method of manufacture is forging of the head in one piece if not the head and handle in one piece. This will require a cylindrical insert to form the blind cavity 22 but is otherwise entirely conventional unless a bifurcated claw 16 is desired on top of the head 12 as shown in FIG. 1 in which case forging is not routine and casting is considered preferable. Lost wax casting is specifically suggested for a head 12 with integral bifurcated claw 16.

Conventional staking of the top of a wood or plastic resin handle 11 is suggested but any suitable means for fixing the head 12 to the top end of a steel handle 11 is also satisfactory. Brazing, welding, and threaded fasteners are specifically suggested. The grip 15, if utilized, is preferably molded from an elastomer. Dip molding in latex rubber is considered satisfactory but use of a vulcanized rubber molded to shape prior fitting upon the bottom half of the handle 11 is preferred. All of these aspects are considered to be well known to one practiced in the art.

It is recognized, moreover, that since investment casting is far more expensive than forging on a large scale production basis, but less expensive in small scale production owing to the relatively large initial investment costs required of forging, and because inclusion of a bifurcated claw 16 on the top of the head 12 as shown in FIG. 1 will greatly increase the cost of forging the same, it may be desirable to forge the head 12 and attach a bifurcated claw 16. In this case it is specifically suggested that a U shaped stake or staple be driven into the top of a wood or other suitably resilient material handle 11 trapping a cross bar between two spaced apart parallel legs disposed flush with the top sides of the forged head 12. The bifurcated claw 16 in this case is preferably investment cast or manufactured from a weldment annealed and heat treated. Investment casting of the head 12, with or without a bifurcated claw 16 at the top, will also require heat treatment after casting but not annealing.

The foregoing is intended to provide one practiced in the art with the best known manner of making and using a preferred embodiment in accordance with the principles relating to the present invention and is not to be construed in any manner as restrictive of said invention or the rights and privileges accorded by Letters Patent in securement of the same and for which I claim:

1. A hammer, intended for manual operation in fastening metal tracks to concrete substrates with a typical track fastener comprised of a radially uniform central steel fastening pin with a fastener point at one end, a fastener head on an opposed end, and a collar enclosing a length of said pin having a maximum diameter of slightly greater dimension than said fastener head, said hammer comprising:

a handle possessing a longitudinal axis substantially perpendicular to a striking axis through two opposed striking ends of an integral one piece head fixed to an upper portion of said handle;

one said striking end possessing a conventional solid configuration presenting a substantially flat face substantially perpendicular to said striking axis;

the other said striking end possessing a cylindrical blind cavity open to an annular face substantially perpendicular to said striking axis and opposed to said substantially flat face presented by said striking end possessing a conventional solid configuration;

said other striking end further possessing a substantially cylindrical configuration with a taper inward from a full diameter behind said blind cavity to a reduced diameter possessed by said annular face substantially perpendicular to said striking axis;

said cylindrical blind cavity having a substantially flat cavity bottom, a radially uniform cavity wall, and a cavity depth and cavity diameter dimensioned to permit insertion of said typical track fastener;

said cavity diameter being approximately equal in dimension to said maximum diameter of said collar and said cavity depth having a dimension lesser than the length of said typical track fastener;

whereby insertion of one said typical track fastener into said cylindrical blind cavity disposing said fastener head against said cavity bottom and said collar in slidable contact with said cavity wall and striking the fastener point against a metal track disposed flush to a backing substrate enables starting of said track fastener with penetration of said fastener point through said metal track and into said backing substrate in position for driving home with impacts delivered with said flat face of said conventional solid striking end.

2. A hammer in accordance with claim 1 further possessing a bifurcated claw disposed on top of said head possessing an operational fulcrum proximate said longitudinal axis of said handle.

3. A hammer in accordance with claim 1 further possessing an elastomer grip disposed upon a lower half of said handle.

4. A hammer in accordance with claim 1 wherein said cylindrical blind cavity possesses a depth of approximately one half of said length of said typical track fastener.

5. A hammer in accordance with claim 1 wherein said solid striking end possesses a substantially cylindrical configuration.

6. A hammer in accordance with claim 5 wherein said substantially cylindrical configuration possessed by said solid striking end is radially uniform about said striking axis.

7. A hammer in accordance with claim 1 wherein said substantially cylindrical configuration possessed by said other striking end possessing said cylindrical blind cavity open to said annular face substantially perpendicular to said striking axis with a taper inward from a full diameter behind said blind cavity to a reduced diameter possessed by said annular face is radially uniform about said striking axis.

* * * * *